US006129235A

United States Patent [19]

Creske

[11] Patent Number: 6,129,235

[45] Date of Patent: Oct. 10, 2000

[54] PARTY TRAY

[75] Inventor: Edward J. Creske, Mossinee, Wis.

[73] Assignee: Creske Corporation, Wausau, Wis.

[21] Appl. No.: 09/211,461

[22] Filed: Dec. 14, 1998

[51] Int. Cl.[7] ..... A67G 19/00

[52] U.S. Cl. ..... 220/575; 220/556; 220/735; 220/737; 206/562; 206/549

[58] Field of Search ..... 220/575, 556, 220/735, 737, 23.83, 23.86; 206/217, 562, 549

[56] References Cited

U.S. PATENT DOCUMENTS

| | | | |
|---|---|---|---|
| 4,219,144 | 8/1980 | Hagelberg | 229/2.5 R |
| 4,461,396 | 7/1984 | Harper | 220/23.83 |
| 5,119,967 | 6/1992 | Ercolani | 220/23.6 |
| 5,152,398 | 10/1992 | Forestal et al. | 206/561 |
| 5,301,871 | 4/1994 | Gross et al. | 229/1.5 H |
| 5,323,910 | 6/1994 | van de Graaf, Jr. | 206/557 |
| 5,429,266 | 7/1995 | D'Oliveira et al. | 220/556 |
| 5,551,593 | 9/1996 | Wiens | 220/575 |
| 5,607,077 | 3/1997 | Torkelson | 220/575 |

*Primary Examiner*—Joseph M. Moy
*Attorney, Agent, or Firm*—Wood, Phillips, VanSanten, Clark & Mortimer

[57] ABSTRACT

A party tray for holding refreshments comprises a panel with an axis, a periphery and a thumbhole through the panel adjacent to the panel periphery and substantially along the axis. The user's thumb of either hand is directed through the thumbhole toward the panel periphery and the panel extends laterally on either side of the user's forearm. The panel may be an elongated ellipse wherein the axis is the major axis of the ellipse. Further, the panel may include a plurality of compartments configured to hold such things as eating utensils, beverage containers and food.

20 Claims, 1 Drawing Sheet

PARTY TRAY

FIELD OF THE INVENTION

This invention relates to a party tray that the user can hold in either hand.

BACKGROUND OF THE INVENTION

Food and beverages are served at most social gatherings. However, it is frequently difficult for a guest to juggle his food and beverage, especially while standing. Generally, one or more items have to be placed on a flat surface in order to free one hand or the other for eating. At many social gatherings flat surfaces can be hard to come by. Therefore, there is a need for a party tray that can easily be held in one of the user's hands while the user is eating with the other hand.

Prior art plates and trays that attempt to alleviate this problem generally include a hole for the user's thumb that allows the user to grip the tray or plate in some fashion. However, most of the prior art trays require that the user's fingers support the weight of everything on the tray, including a beverage container. Additionally, some of the prior art trays cannot be set down without first removing beverage containers and/or other items. Furthermore, most of these trays are difficult to eat from because the pressure of a fork or knife on the tray must be supported by the fingers, which may be awkward to balance and not provide enough support.

One party plate that attempts to alleviate such awkward balancing and support is described in U.S. Pat. No. 5,323,910 to van de Graaf, Jr. which issued Jun. 28, 1994. This party plate includes a typical thumbhole in a corner of the plate, but is configured to be supported by the user's forearm. However, the relationship of the thumbhole to the rest of the tray requires that this plate be held solely in the user's left hand.

SUMMARY OF THE INVENTION

A party tray that can be held in either hand comprises a panel for holding refreshments, wherein the panel has an axis and a periphery with a thumbhole through the panel adjacent to the panel periphery and substantially along the axis. The thumb of either of the user's hands is directed through the thumbhole toward the panel periphery as the panel rests on and extends laterally on both sides of the user's forearm. The panel may be elliptical wherein the axis is the major axis of the ellipse. The panel may also include a plurality of compartments configured to hold food, eating utensils and a beverage container. The compartments have walls to segregate different items and to keep food away from the user's thumb. The party tray includes a concave gripping surface for the user's fingers. This party tray is further configured to lie substantially flat on a flat surface and to nest when empty. The party tray may be made of formed plastic or formed cardboard.

BRIEF DESCRIPTION OF THE DRAWINGS

A more complete understanding of this invention may be obtained from consideration of the following detailed description in conjunction with the drawings, in which.

DETAILED DESCRIPTION

An elliptical party tray that has a thumbhole substantially on a major axis adjacent to a periphery provides the user with a convenient holder for food, a beverage container and eating utensils. The party tray rests on the user's forearm to provide support to the tray so that the user's hand is not the sole means of support and the user can use implements such as a fork without tipping the tray. The party tray is divided into a plurality of compartments to keep food segregated and may include a compartment for utensils so that the user can use the utensils one at a time.

Figure 1:
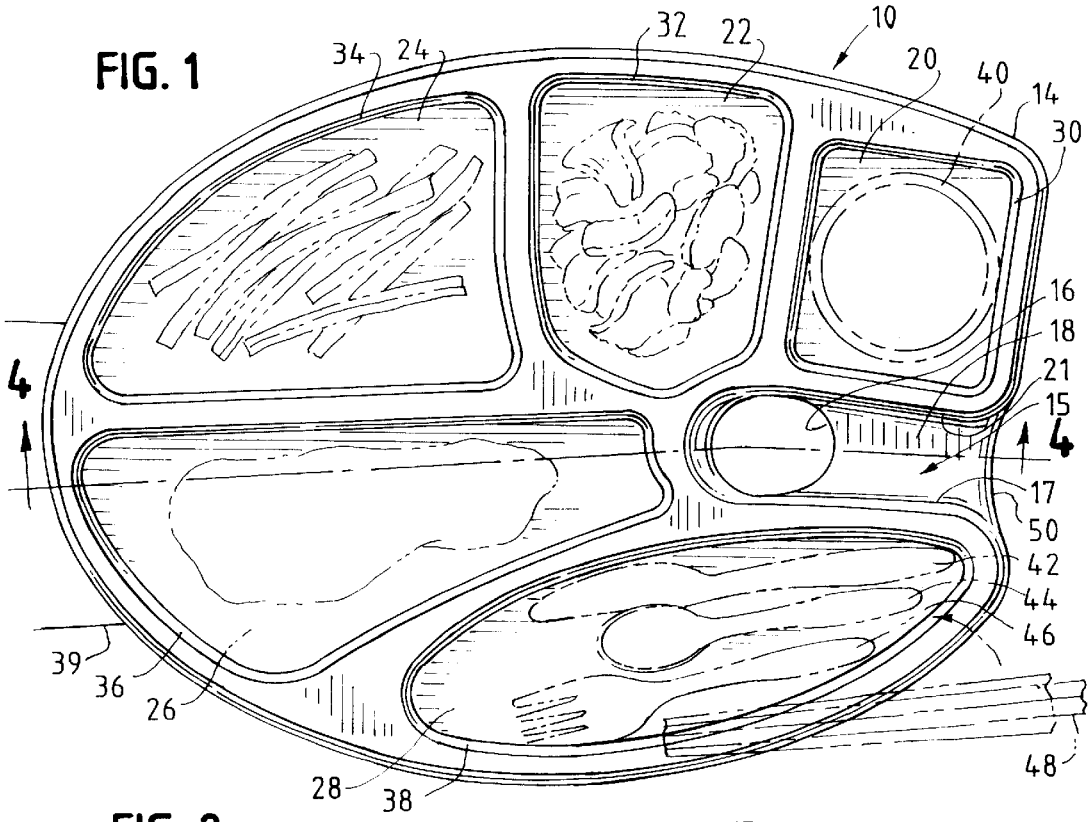
FIG. 1 is a top view of a party tray holding utensils, food and beverage items.

The party tray illustrated in FIG. 1 is a panel 10 with a major axis 12 and a periphery 14. The party tray includes a thumbhole 16 and thumb print pad 18 in a recess 15 having walls 17,21 for the user's thumb 19 (FIGS. 2 and 3) along the axis 12 and adjacent to the periphery 14. Panel 10 is generally elliptical with the axis 12 being the major axis of the elliptic. Panel 10 is formed in one piece of plastic but may be formed in many other shapes and materials (such as ceramic or wood) without departing from the scope of the appended claims.

Panel 10 has a plurality of compartments, 20, 22, 24, 26 and 28, defined by walls 30, 32, 34, 36 and 38, respectively. The compartments 20, 22, 24, 26 and 28 are substantially equally arranged on either side of the axis 12 so that the panel 10 is balanced on the user's forearm 39. Each of the compartments 20, 22, 24, 26 and 28 may contain utensils, food, food containers or beverage containers. In this exemplary embodiment, an outline of a beverage container 40, which may be the bottom of a cup or a can, is shown in compartment 20. The size of compartment 20 may be selected so that there is a friction fit between the compartment 20 and the bottom of the beverage container 40. Of course, the beverage compartment 20 may also be round.

Panel 10 is illustrated in FIG. 1 as having compartments 20, 22, 24, 26 and 28 to hold an entire meal. Compartment 22 is illustrated holding a salad. This shows the advantages of the compartment 22 and wall 32 because the salad dressing cannot mix with the other foods or run onto the user's thumb. Compartment 24 is illustrated as holding french fries. Compartment 26 is illustrated holding an entree. Compartment 28 is used in this exemplary embodiment to hold eating utensils such as knife 42, spoon 44, and fork 46. Alternatively, compartment 28 may be of a size and shape that would facilitate holding implements such as chopsticks 48. In this manner, the eating utensils are handy for the user and may be exchanged rapidly without having to handle more than one at a time or leaving the utensils in the food compartments. Of course, the configuration of compartments may be varied to suit specific needs. It is advantageous that the panel 10 is arranged to extend laterally on both sides of the forearm 39 and that the compartment 20, 22, 24, 26 and 28 are arranged to balance on the forearm.

Figure 2:
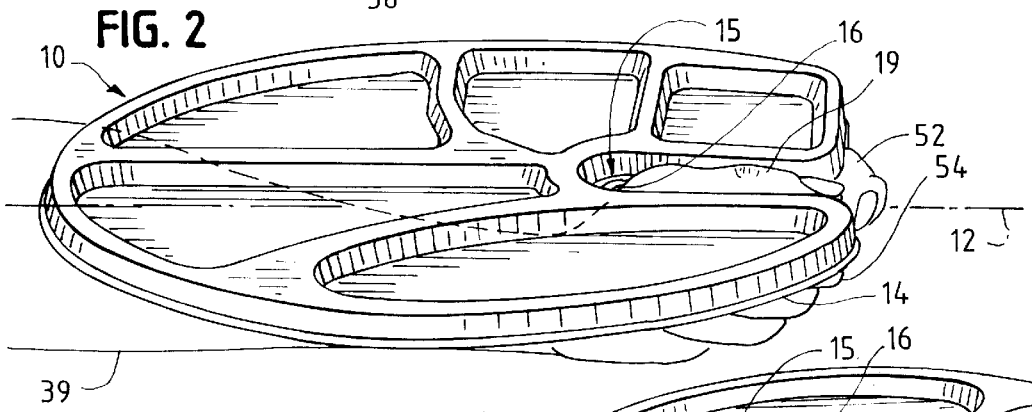
FIG. 2 is a perspective view of the party tray of FIG. 1 on the left arm of a user.

The periphery 14 of panel 10 includes a concave gripping surface 50 for the user's forefinger 52 or forefinger 52 and center finger 54 (FIG. 2). This gripping surface 50 permits the user to hold the panel 10 comfortably on the forearm 39 and provides a firm grip when the panel 10 is fully loaded.

Turning now to FIG. 2, a perspective view of a party tray comprising panel 10 is shown. In this view, the relationship of the party tray's major axis 12 to the user's thumb 19 and fingers 52 and 54 is shown. The user's thumb 19 extends along the major axis 12 within the recess 15 and points toward the periphery 14 of the tray. Further, the major axis 12 extends over the user's forearm 39. In this manner, the user may easily support and balance the panel 10.

Figure 3:
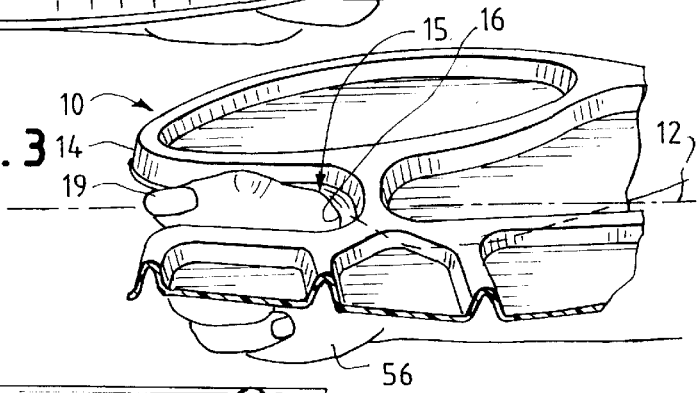
FIG. 3 is a semi cut-away perspective view of the party tray of FIG. 1 showing the user holding the tray with the right hand with the party tray on the right arm.

FIG. 3 is a perspective view of panel 10 being held in the user's right hand 56. In this drawing, the user's right thumb 19 passes through thumbhole 16 and extends within the recess 15 along the major axis 12 of panel 10. The majority of the body of panel 10 rests on the user's arm. This illustration shows that the user may use the party tray of this invention in either hand.

Figure 4:
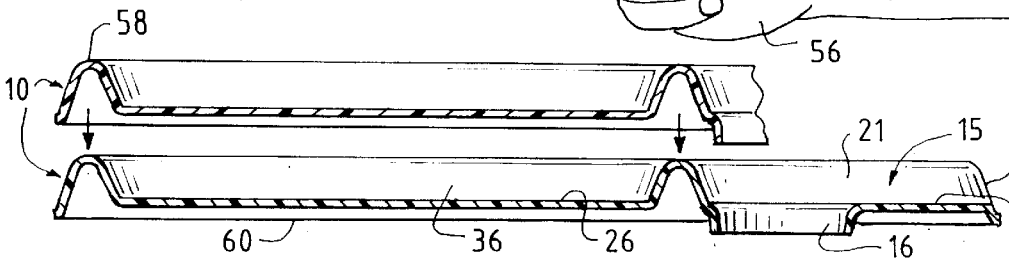
FIG. 4 is a cross-sectional view of the party tray of FIG. 1 taken along the line 4—4.

Turning now to FIG. 4, a cross-sectional view taken along line 4—4 of FIG. 1 is shown. FIG. 4 illustrates that thumbhole 16 is generally proximate to the periphery 12 of the panel 10. The periphery 14 includes a peripheral wall 58. The peripheral wall 58, which in the embodiment of FIG. 1, preferably forms walls 17 and 21 of the recess 15 and compartment walls 36 are generally U-shaped with a slight flair at the open end of the U. U-shaped walls 58 and 36 enable several panels 10 to nest for easy storage. Panel 10 also includes a bottom peripheral flange 60 that is planar. Thus, panel 10 rests substantially flat when placed on a flat surface without having to remove the beverage container or other objects from the party tray.

It will therefore be understood that this party tray has a major axis and a thumbhole along the major axis near a periphery of the party tray. A user inserts either thumb through the thumbhole toward the periphery and balances the tray on his forearm. Thus, the party tray is balanced and well supported and may be used when the user is standing or seated, or used when flat on a surface as a sectioned plate.

It is to be understood that the above-described embodiment is to illustrate the principles of the invention, and that those skilled in the art may devise many variations without departing from the scope of the invention. It is, therefore, intended that such variations be included within the scope of the appended claims.

What is claimed is:

1. A party tray for carrying refreshments, comprising:

a panel for refreshments, the panel having an axis and a periphery with a thumbhole through the panel substantially on the axis adjacent to the panel periphery and directed along the axis to receive a thumb of either hand of a user, with the thumb directed toward the panel periphery and the panel resting on and extending laterally on either side of the user's forearm, said panel defining a recess extending along said axis from said thumbhole, for receiving the thumb, said recess including walls disposed on opposite sides of said axis and extending substantially parallel to said axis, said walls providing a bearing surface for said thumb to resist rotation of said party tray about said thumbhole.

2. The party tray of claim 1 wherein the panel is elongated.

3. The party tray of claim 1 wherein the axis is the panel's major axis.

4. The party tray of claim 1 wherein the panel is substantially elliptical, and the axis is the major axis of the elliptic.

5. The party tray of claim 1 wherein the panel includes a plurality of compartments.

6. The party tray of claim 5 wherein at least one of said compartments is configured to receive eating utensils.

7. The party tray of claim 5 wherein at least one of said compartments is configured to retain a bottom portion of a beverage container by a friction fit.

8. The party tray of claim 7 wherein said compartment that is configured to releasably hold a beverage container is adjacent to the thumbhole.

9. The party tray of claim 5 wherein said compartments are configured to retain liquids.

10. The party tray of claim 5 wherein said compartments are configured to keep food away from the user's thumb.

11. The party tray of claim 5 wherein the periphery of the panel on the axis adjacent the thumbhole affords a gripping surface for one or more of the user's finger.

12. The party tray of claim 11 wherein the gripping surface is concave.

13. The party tray of claim 1 wherein the periphery and compartments have U-shaped walls configured so that a plurality of the party trays are stackable in a nested relationship.

14. The party tray of claim 1 wherein said panel comprises plastic.

15. The party tray of claim 5 wherein said panel comprises formed plastic.

16. The party tray of claim 5 wherein said panel comprises formed cardboard.

17. The party tray of claim 5 wherein the compartments are substantially equally arranged on either side of the axis.

18. The party tray of claim 5 wherein the compartments are partially separated by walls extending substantially parallel to the axis, to thereby provide stiffening of the party tray in an axial direction.

19. The party tray of claim 18 wherein the compartments are partially separated by walls extending substantially perpendicular to the axis, to thereby provide stiffening of the party tray in a direction transverse to the axis.

20. (Added claim) The party tray of claim 5 wherein the compartments are partially separated by walls extending substantially perpendicular to the axis, to thereby provide stiffening of the party tray in a direction transverse to the axis.

* * * * *